US006787937B2

(12) United States Patent
Mody et al.

(10) Patent No.: US 6,787,937 B2
(45) Date of Patent: Sep. 7, 2004

(54) METHOD OF OPERATING REMOTE OPERATED CIRCUIT BREAKER PANEL

(75) Inventors: Hemant Kumar Mody, Avon, CT (US); Guillermo Wille, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 52 days.

(21) Appl. No.: 10/248,036

(22) Filed: Dec. 12, 2002

(65) Prior Publication Data

US 2003/0090349 A1 May 15, 2003

Related U.S. Application Data

(62) Division of application No. 09/682,580, filed on Sep. 24, 2001, now Pat. No. 6,522,227.

(51) Int. Cl.[7] ..... H01H 19/14

(52) U.S. Cl. ..... 307/115; 335/14; 335/20; 335/68

(58) Field of Search ..... 307/113, 115; 335/14, 20, 68

(56) References Cited

U.S. PATENT DOCUMENTS

| | | | | |
|---|---|---|---|---|
| 4,623,859 A | | 11/1986 | Erickson et al. | 335/14 |
| 4,965,694 A | | 10/1990 | Dvorak et al. | 361/64 |
| 5,180,051 A | | 1/1993 | Cook et al. | 200/400 |
| 5,821,876 A | * | 10/1998 | Farrington et al. | 340/3.2 |
| 6,034,581 A | | 3/2000 | DiMarco et al. | 335/16 |
| 6,204,741 B1 | | 3/2001 | Becker et al. | 335/68 |
| 6,326,870 B1 | * | 12/2001 | Larranaga et al. | 335/68 |

* cited by examiner

*Primary Examiner*—Robert L DeBeradinis
(74) *Attorney, Agent, or Firm*—Cantor Colburn LLP

(57) ABSTRACT

A remote operated device including: a plurality of circuit breakers; a first actuator in operable communication with a second actuator, the first actuator positions the second actuator at a circuit breaker of the plurality of circuit breakers, the second actuator mounted external to the plurality of circuit breakers, the second actuator moves a handle of the circuit breaker to an on position, an off position, or performs a reset operation; and a controller in electronic communication with the first actuator and the second actuator.

6 Claims, 8 Drawing Sheets

METHOD OF OPERATING REMOTE OPERATED CIRCUIT BREAKER PANEL

CROSS REFERENCE TO RELATED APPLICATIONS

This Application is a divisional application of U.S. application Ser. No. 09/682,580 filed Sep. 24, 2001, now U.S. Pat. No. 6,522,227 which is hereby incorporated by reference in its entirety.

BACKGROUND OF THE INVENTION

In large commercial buildings, electricity savings are accomplished by turning lights on and off automatically at predetermined times. Two schemes are commercially available for implementing this service. One uses lighting contractors protected by circuit breakers and the other uses remote controlled circuit breakers. Both schemes rely on a user programmable logic device to command the circuit breaker to turn on and off. Both of these schemes effectively conserve electricity. However, one drawback of these schemes is that they are expensive to implement because each circuit breaker must include means for receiving signals from the logic device and contain individual motorized actuation means. Another drawback is that the circuit beakers used in such systems tend to be larger than normal circuit breakers to accommodate the means for receiving signals from the logic device and contain individual motorized actuation means.

BRIEF DESCRIPTION OF THE INVENTION

The above discussed and other drawbacks and deficiencies of the prior art are overcome or alleviated by a remote operated device including: a plurality of circuit breakers; a first actuator in operable communication with a second actuator, the first actuator positions the second actuator at a circuit breaker of the plurality of circuit breakers, the second actuator mounted external to the plurality of circuit breakers, the second actuator moves a handle of the circuit breaker to an on position, an off position, or from a trip to off position (i.e., a reset operation ); and a controller in electronic communication with the first actuator and the second actuator.

BRIEF DESCRIPTION OF THE DRAWINGS

Referring to the exemplary drawings wherein like elements are numbered alike in the several Figures.

DETAILED DESCRIPTION

Figure 1:
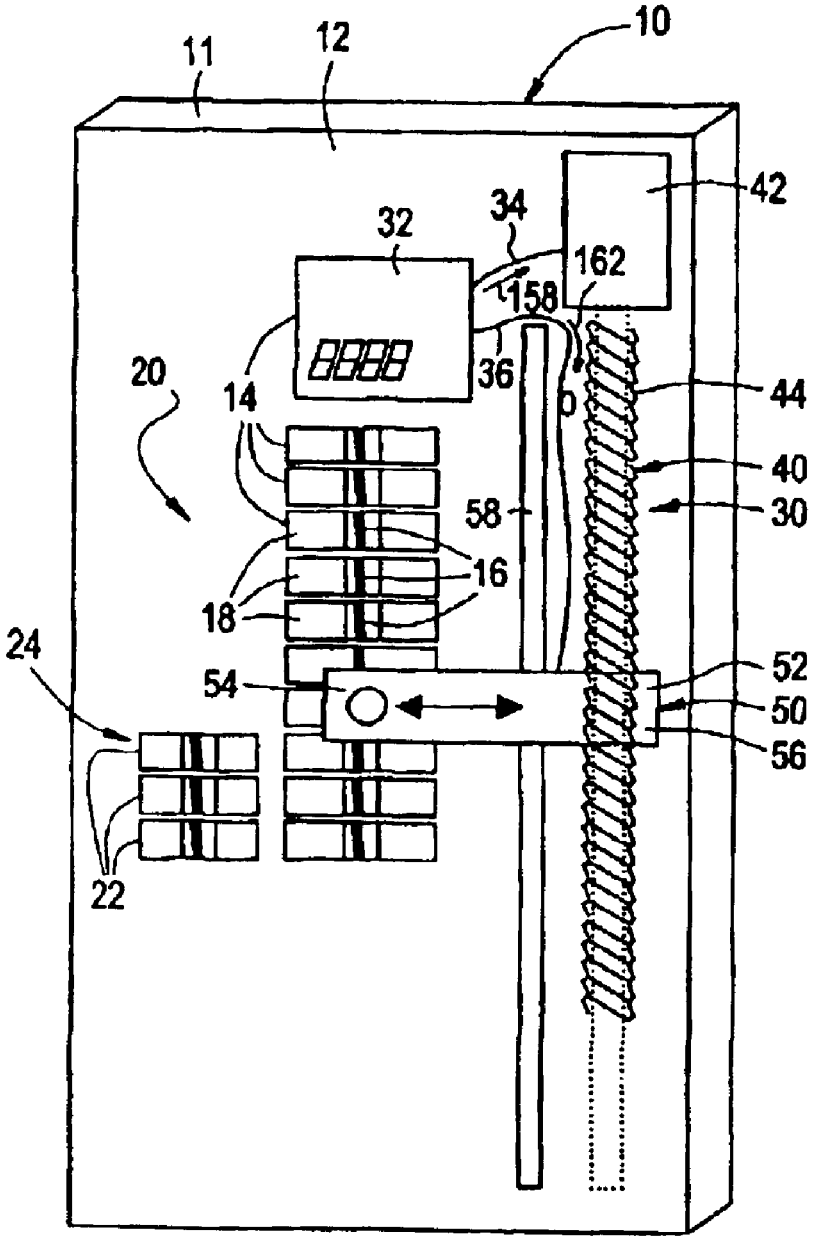
FIG. 1 is a front view of an electrical enclosure with a remote operated device.

Referring to FIG. 1, a front view of an electrical enclosure 10 is illustrated. Electrical enclosure 10 may include a switchboard, panelboard, or any other type of enclosure that includes electrical devices. Electrical enclosure 10 comprises a frame 11 and a cover 12. Cover 12 includes a plurality of apertures 14 through which handles 16 of circuit breakers 18 extend. Handles 16 extend generally perpendicular from cover 12. Circuit breakers 18 are usually mounted in a first row 20; however, sometimes circuit breakers 22 may be located adjacent to first row 20. While circuit breakers 22 are shown to the left of first row 20, circuit breakers 22 may also be located to the right of first row 20. Circuit breaker 22 may also include a plurality of circuit breakers 22 arranged in a second row 24. Electrical enclosure 10 also includes a remote operated device 30 that is mounted to cover 12 and allows an operator (not shown) to turn on, off, or reset one or more circuit breakers 18 and 22 from a remote location.

Remote operated device 30 includes a controller 32, which extends through aperture 14 of cover 12. Controller 32 is coupled by a line 34 with a first actuator 40 and by a line 36 with a second actuator 50. Line 34 may be a wire, or any other type of connection that conducts electrical current. Line 36 is preferably a flex cable, which will allow second actuator 50 to move up and down along first row 20.

First actuator 40 is located adjacent and parallel to first row 20 of circuit breakers 18. First actuator 40 includes a motor 42, which is preferably a stepper motor, mounted to cover 12. Motor 42 is rotatably coupled to screw 44 so that when motor 42 is energized, motor 42 rotates screw 44. Screw 44 is also mounted to cover 12 in a manner that allows screw 44 to rotate.

Second actuator 50 is mounted perpendicular to first actuator 40. Second actuator 50 includes a body portion 52, which is generally rectangular and includes a first end 54 and a second end 56. First end 54 is located at first row 20 of circuit breakers 18 and second end 56 is threadably engaged with screw 44. A guide 58, which is parallel to first row 20 and mounted to cover 12, supports body portion 52.

Figure 2:
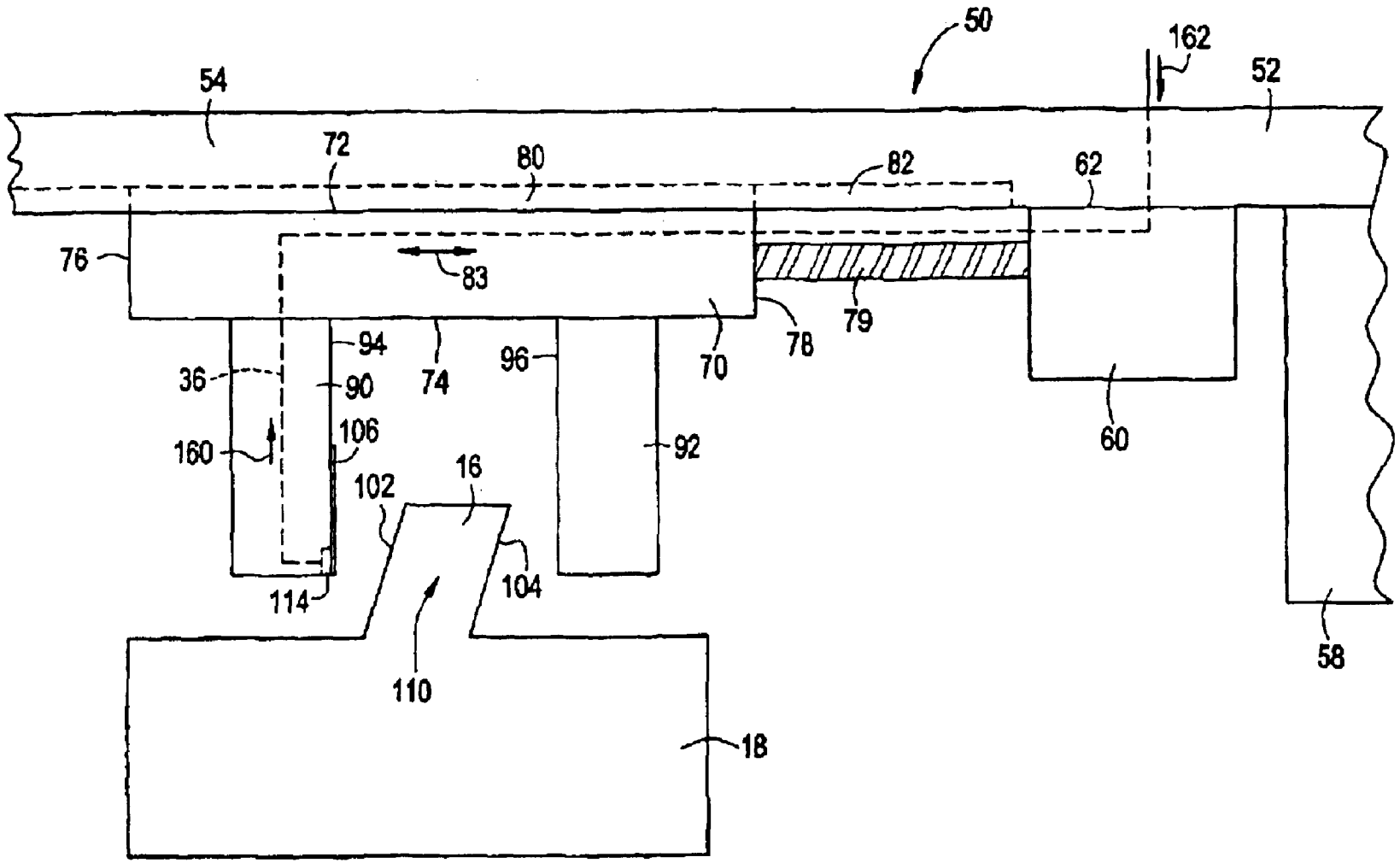
FIG. 2 is a side view of the remote operated device in FIG. 1 illustrating a second actuator and a circuit breaker in the "on" position.

Referring to FIG. 2, a detailed illustration of second actuator 50 is shown. Second actuator 50 includes a motor 60 mounted to a first side 62 of body portion 52 adjacent to guide 58. Second actuator 50 also includes a plate 70, which has a generally rectangular shape. Plate 70, which includes a first side 72, a second side 74, a third side 76, and a fourth side 78, is located at first end 54 of body portion 52. First side 72, which faces first side 62 of body portion 52, has a tab 80 that extends outward from first side 72 and extends the length of first side 72 from third side 76 to fourth side 78. Body portion 52 has a slot 82 located at first side 62 to receive tab 80 so that plate 70 is slideably mounted to body portion 52. Slot 82 extends past plate 70 on both third side 76 and fourth side 78 so that plate 70 can slide along body portion 52 in the direction of an arrow 83. Motor 60 is coupled to plate 70 by a shaft 79.

Plate 70 is coupled to a first arm 90 and a second arm 92 that extend generally perpendicular from second side 74. First arm 90 has a first surface 94 that faces a first surface 96 of second arm 92. First arm 90 is located adjacent to a first side 102 of a handle 16 of circuit breaker 18. Second arm 92 is located adjacent to a second side 104 of handle 16. A soft slab 106, such as an elastomer, is attached to first surface 94 of first arm 90. Soft slab 106 is also attached to first surface 96 of second arm 92, however, it is not depicted in FIG. 2. Alternatively, arms 90 and 92 may be made from a soft matter, such as an elastomer.

Figure 3:
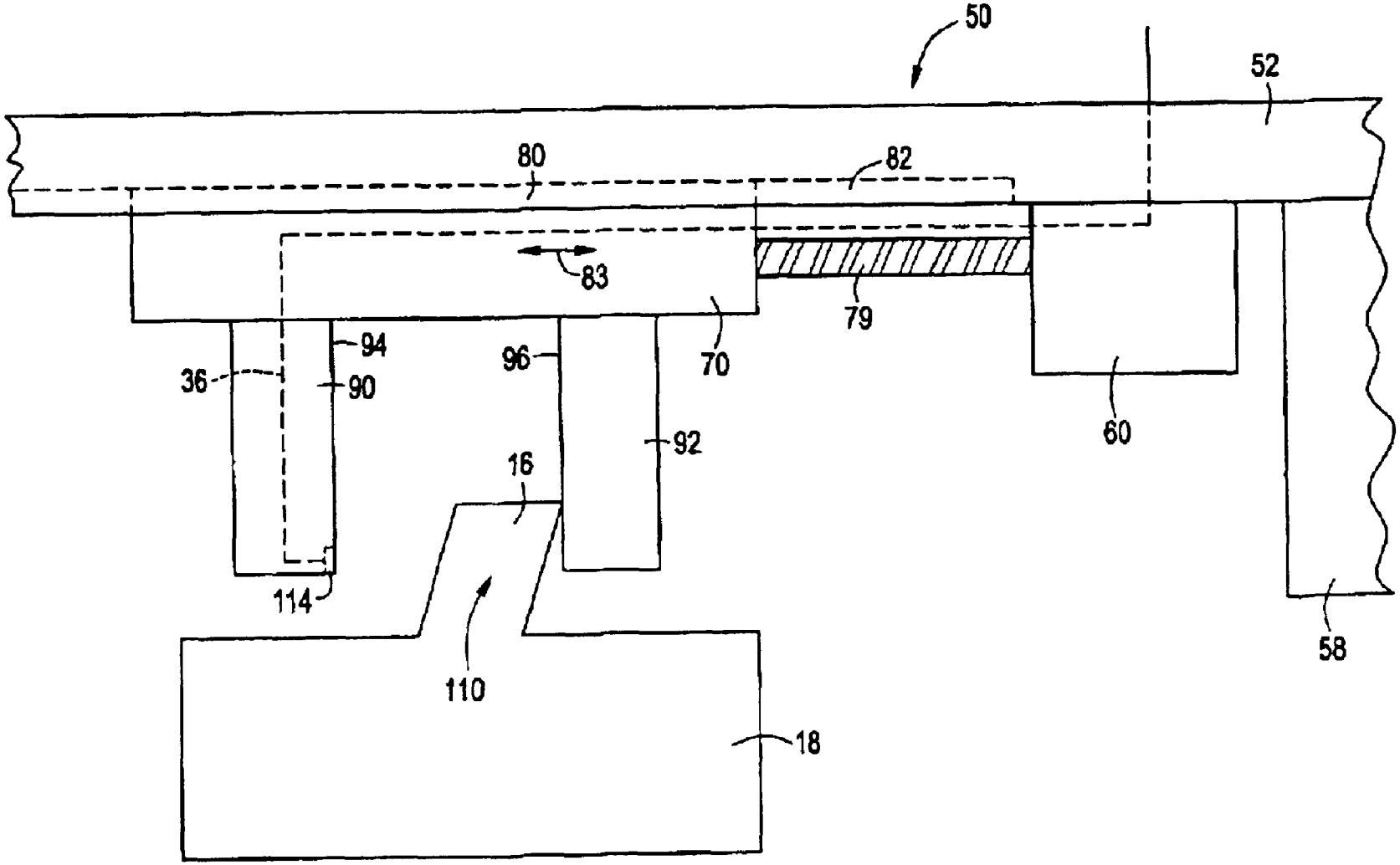
FIG. 3 is the second actuator of FIG. 2 positioned just before the second actuator turns the circuit breaker from the "on" position to the "off" position.
Figure 4:
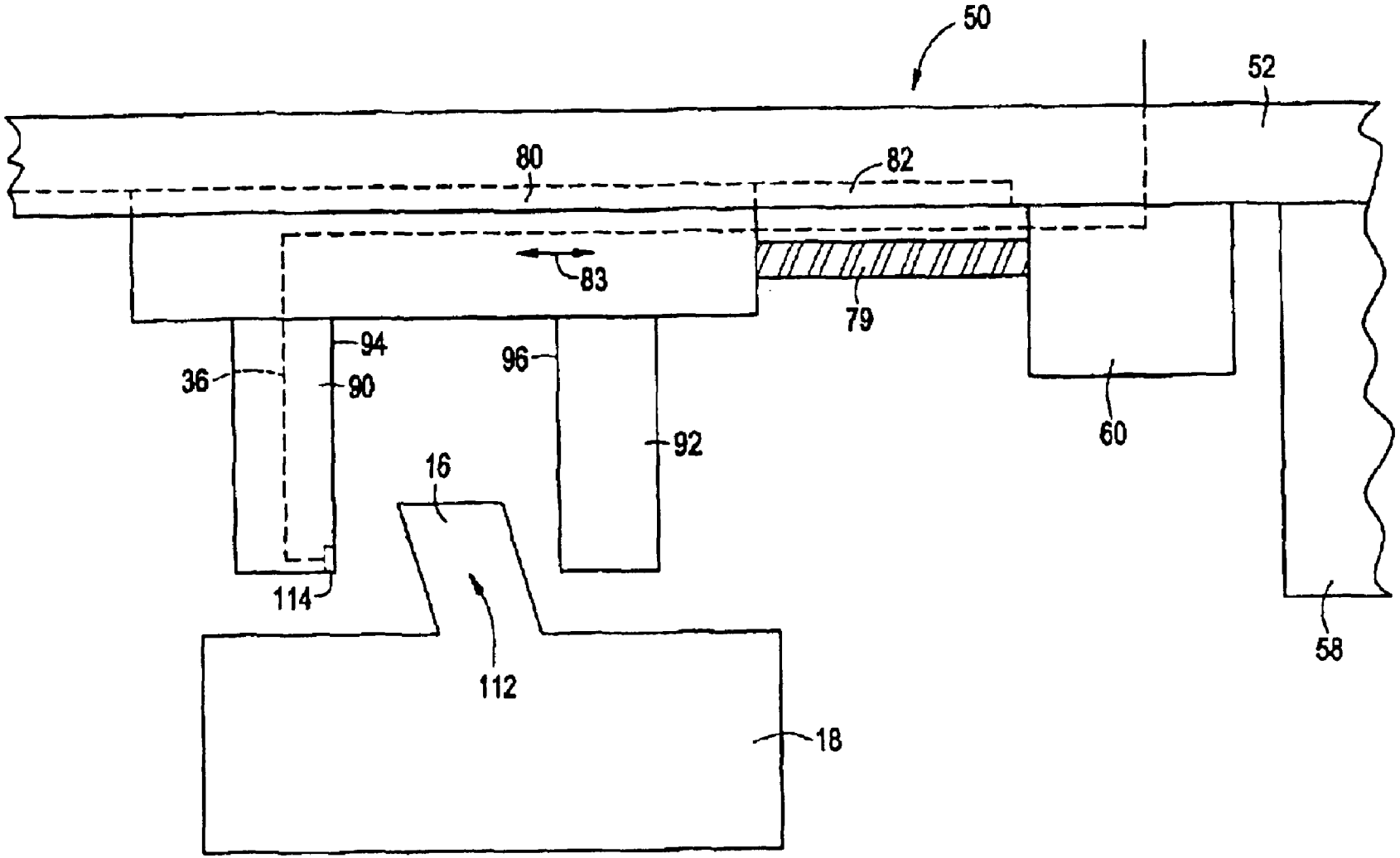
FIG. 4 is the second actuator of FIG. 2 after the second actuator has moved the circuit breaker to the "off" position.

Referring to FIGS. 2–4, handle 16 turns circuit breaker 18 to an on position 110 (see FIGS. 2 and 3), an off position 112 (see FIG. 4), or from a trip to off position to perform a reset operation. When circuit breaker 18 is in on position 110, electrical contacts (not shown) within the circuit breaker are touching and allow current and/or voltage to travel through circuit breaker 18. When circuit breaker 18 is in off position 112, the electrical contacts are separated, which does not allow the current and/or voltage to travel through circuit breaker 18. When circuit breaker 18 is in the trip position (not shown), circuit breaker 18 has tripped because a fault condition has been detected and acted upon.

In order to determine whether handle 16 is in on position 110, off position 112, or the trip position, a position sensor 114 is mounted to first surface 94 of first arm 90 and faces first side 102 of handle 16. Position sensor 114 can sense the distance to handle 16 to determine whether handle 16 is in on position 110, off position 112, or the trip position. Alternatively, position sensor 114 can be mounted to first surface 96 of second arm 92, which is not depicted in the figures. Position sensor 114 is coupled with controller 32 (shown in FIG. 1) by line 36.

Figure 5:
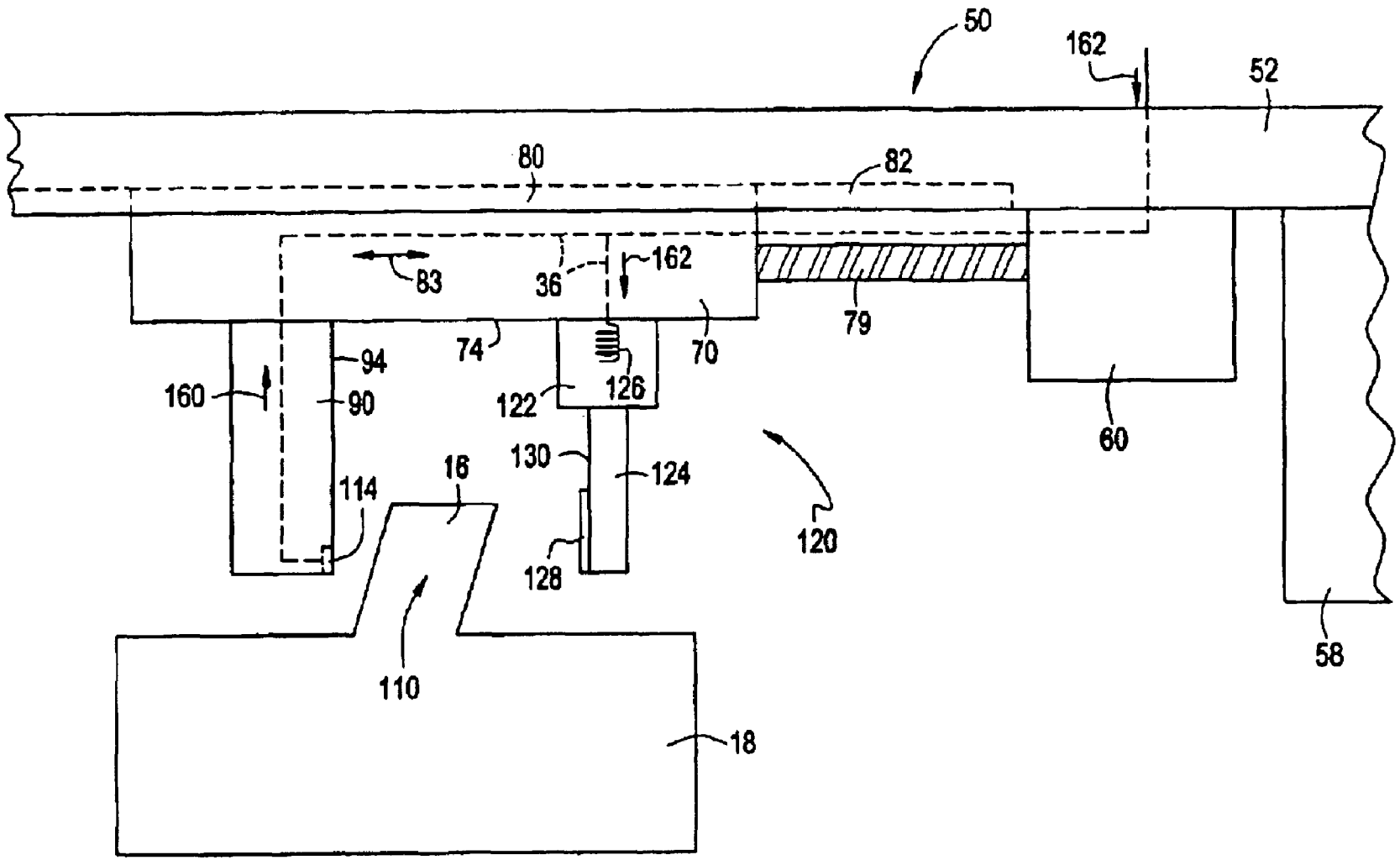
FIG. 5 is a side view of the remote operated device in FIG. 1 illustrating a third actuator in the "extended" position.

Referring to FIGS. 1, 5–7, remote operated device 30 may also include a third actuator 120, which is located in place of first arm 90 (FIG. 6) and/or second arm 92 (FIG. 5). As shown in FIG. 5, third actuator 120 has replaced second arm 92. Third actuator 120 allows second actuator 50 to extend to circuit breaker 22, which is located in second row 24. As shown in FIG. 1, circuit breaker 22 is located to the left of first row 20; thus, second arm 92 would be removed and replaced with third actuator 120. Third actuator 120 allows second actuator 50 to move to the left of first row 20 to reach circuit breaker 22 without interfering with handle 16.

Figure 6:
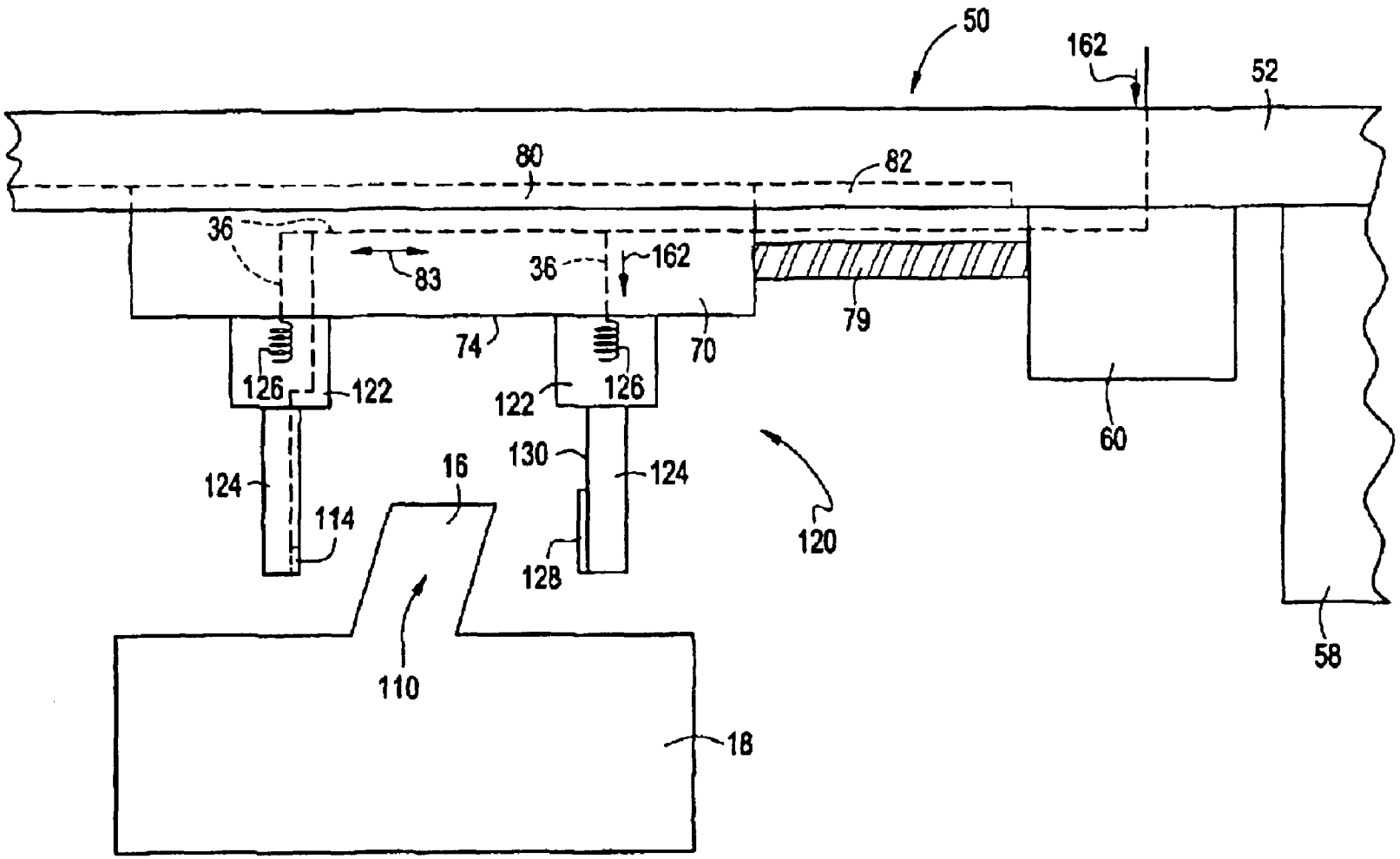
FIG. 6 is a side view of the remote operated device in FIG. 1 illustrating an alternative embodiment of a third actuator in the "extended" position.
Figure 7:
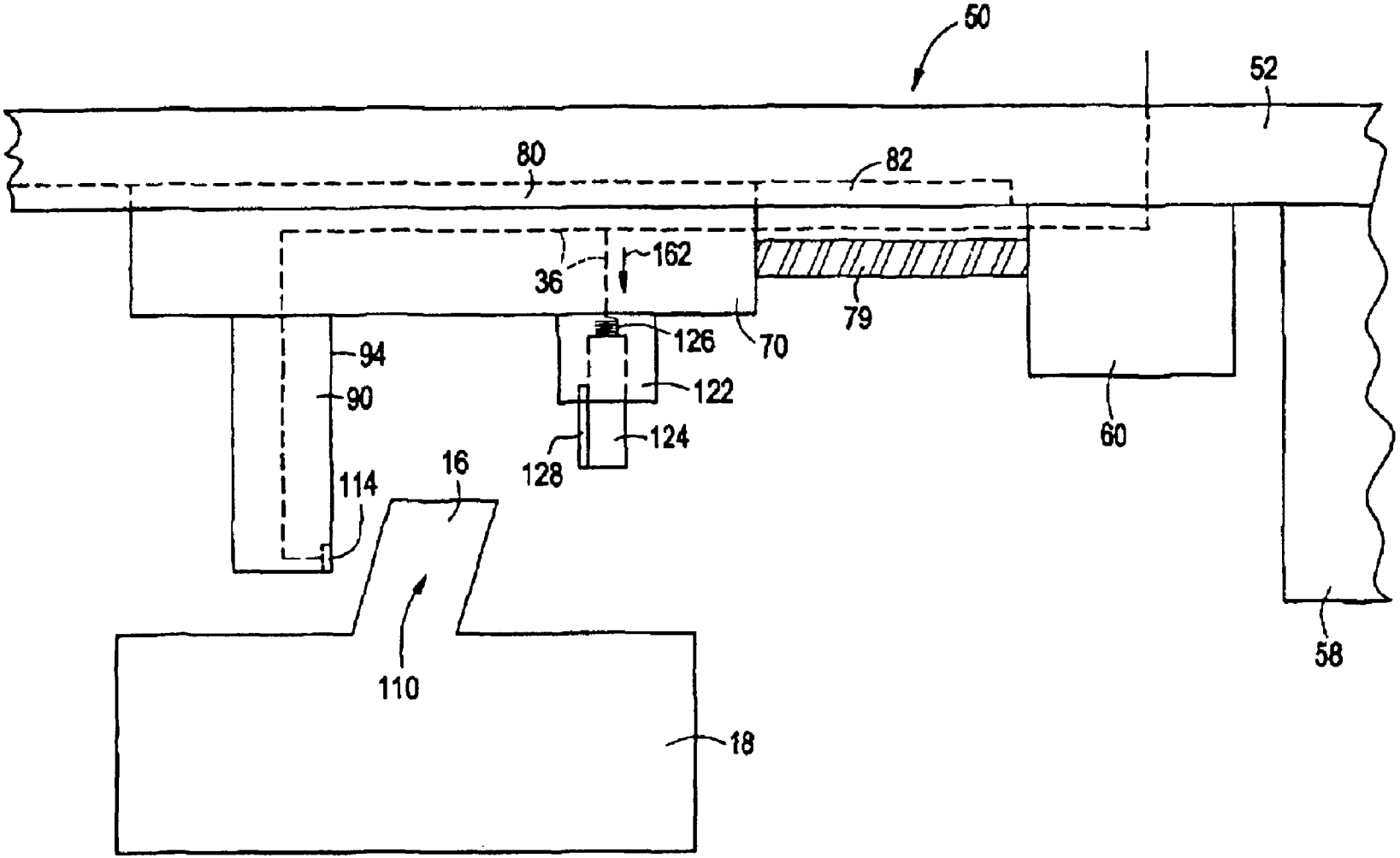
FIG. 7 is the third actuator in FIG. 5 in the "withdrawn" position.

Third actuator 120 allows circuit breaker 22, which is located in second row 24 to be turned on and off. A solenoid body 122 is coupled to second side 74 of plate 70. Solenoid body 122 includes a plunger 124, which can slide in and out of solenoid body 122. FIGS. 5 and 6 illustrate plunger 124 extending from solenoid body 122 and FIG. 7 illustrates plunger 124 retracted inside solenoid body 122. Solenoid body 122 is coupled to controller 32 by line 36. When controller 32 energizes solenoid body 122, plunger 124 is withdrawn into solenoid body 122. When solenoid body 122 is no longer energized, a spring 126 located within solenoid body 122 pushes plunger 124 out of solenoid body 122. A soft slab 128, such as elastomer, is attached to a surface 130 of plunger 124.

Figure 8:
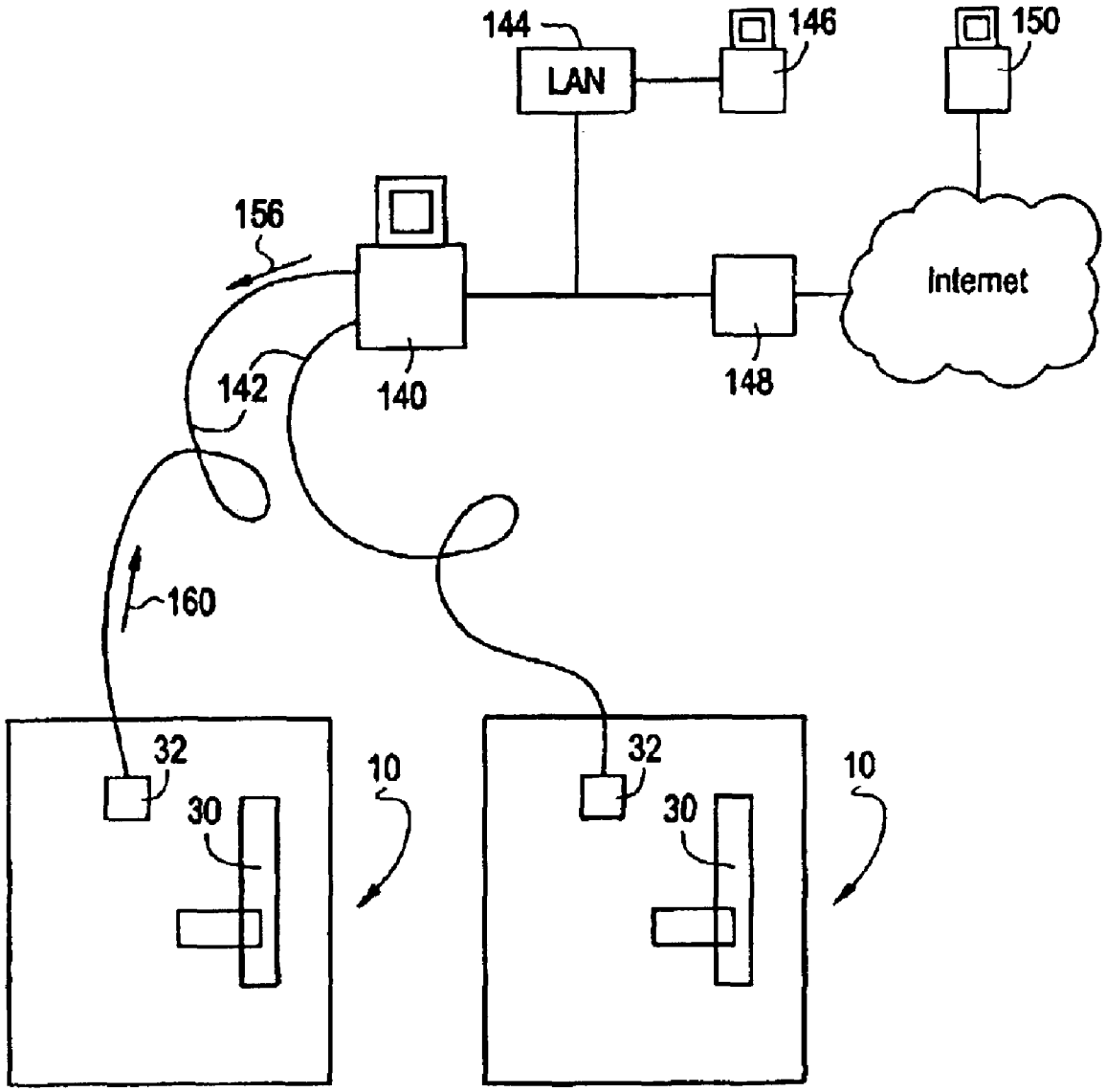
FIG. 8 is a schematic drawing of the remote operated device in FIG. 1 attached to a computer system.

Referring to FIG. 8, controller 32 is operably coupled with a computer 140 by a data transmission media 142. Computer 140 is a suitable electronic device capable of accepting data and instructions, executing the instructions to process the data, and presenting the results. Therefore, computer 140 can be a microprocessor, microcomputer, a minicomputer, an optical computer, a board computer, a complex instruction set computer, an ASIC (application specific integrated circuit), a reduced instruction set computer, an analog computer, a digital computer, a molecular computer, a quantum computer, a cellular computer, a superconducting computer, a supercomputer, a solid-state computer, a single-board computer, a buffered computer, a computer network, a desktop computer, a laptop computer, a scientific computer, a scientific calculator, or a hybrid of any of the foregoing. While computer 140 is shown as being separated from electrical enclosure 10, computer 140 can also be mounted to and/or integrated with electrical enclosure 10.

Data transmission media 142 includes, but is not limited to, twisted pair wiring, coaxial cable, and fiber optic cable. Data transmission media 142 also includes, but is not limited to, radio and infrared signal transmission systems. Computer 140 is configured to provide operating signals to controller 32 and to receive data from these components via data transmission media 142.

In addition to being coupled to controller 32, computer 140 may also be coupled to external computer networks such as a local area network (LAN) 144 and the Internet. LAN 144 interconnects one or more remote computers 146, which are configured to communicate with computer 140 using a well-known computer communications protocol such as TCP/IP (Transmission Control Protocol/Internet Protocol), RS-232, ModBus, and the like. Additional electrical enclosures 10 may also be connected to LAN 144 with the computers 140 in each of these electrical enclosures 10 being configured to send and receive data to and from remote computers 146 and other electrical enclosures 10. LAN 144 is connected to the Internet via a server computer 148. This connection allows computer 140 to communicate with one or more remote computers 150 connected to the Internet.

While specific embodiments have been described in relation to first actuator 40, second actuator 50, and third actuator 120, it will be appreciated by one skilled in the art that any type of actuator can be utilized in place of first actuator 40, second actuator 50, and third actuator 120. For instance, a belt driver actuator or a solenoid could replace first and second actuators 40 and 50. In addition a motor actuator could replace third actuator 120.

Referring to FIGS. 1–7, the operation of remote operated device 30 is as follows. An operator (not shown), who can be located at computer 140, 146, or 150, provides an input signal 156, which travels along data transmission media 142. Signal 156 indicates which circuit breaker is to be controlled and the position (on/off/trip) desired. Controller 32 receives signal 156 and determines the location of the circuit breaker to be controlled. Controller 32 sends a signal 158 to first actuator 40 directing first actuator 40 to move second actuator 50 to the circuit breaker to be controlled.

Once second actuator 50 is positioned over the circuit breaker to be controlled, position sensor 114 sends a signal 160 along line 36 to controller 32 indicating the position of the circuit breaker to be controlled. If the circuit breaker is in the position desired, signal 160 indicates an error and signal 160 is sent along data transmission media 142 to the operator. If the circuit breaker to be controlled is not in the desired position, controller 32 sends a signal 162 along line 36, directing second actuator 50 to move handle 16.

Second actuator 50 functions when motor 60 energizes and drives shaft 79. If the circuit breaker is in on position 110 and off position 112 is desired, shaft 79 pushes plate 70 so that second arm 92 contacts handle 16 and pushes handle 16 to off position 112. Once second arm 92 begins to push handle 16, handle 16 will then flip to off position 112. FIGS. 2–4 illustrate handle 16 being pushed from left to right. As shown in those figures, FIG. 2 illustrates on position 110, FIG. 3 illustrates arm 92 contacting handle 16, and FIG. 4 illustrates off position 112. Although not shown in the Figures, if the operator desires to turn the circuit breaker from off position 112 to on position 110, shaft 79 pulls plate 70 so that first arm 90 contacts handle 16 and moves handle 16 to on position 110.

In addition, the operator could also verify the position of circuit breaker 18. In that scenario, the operation provides input signal 156 to determine the position of a desired circuit breaker. In that case, first actuator 40 would position second actuator 50 over the specific circuit breaker. Position sensor 114 would then send signal 160 to the operator indicating the position of the desired circuit breaker.

Third actuator 120 is energized when the operator desires to operate circuit breaker 22, which is located in second row 24. The operator, who can be located at computer 140, 146, or 150, provides signal 156, which travels along data transmission media 142. Controller 32 receives signal 156 and sends signal 158 to first actuator 40 to energize. First actuator 40 positions second actuator 50 so that second actuator 50 is just above or below second row 24.

After second actuator 50 is properly aligned, controller 32 sends a signal 162 along line 36 to solenoid body 122. Solenoid body 122 energizes, which causes plunger 124 to be withdrawn into solenoid body 122. When plunger 124 is withdrawn, plate 70 then moves to the left. Because plunger 124 is withdrawn into solenoid body 122, second actuator 50 can move to second row 24 without interfering with handle 16. In addition, position sensor 114 is located on first arm 90 so as not to interfere with solenoid body 122. Once second actuator 50 extends to second arm 24, first actuator 40 activates to move second actuator 50 to the desired circuit breaker 22. Alternatively, solenoid body 122 can be located in place of first arm 90 if circuit breaker 22 is located to the right of first row 20.

In addition, third actuator 120 can be located at both first arm 90 and second arm 92. In that embodiment, first actuator 40 positions second actuator 50 at the desired circuit breaker 22. Because both arms 90 and 92 are replaced with third actuators 120, then third actuator 120 will not interfere with handle 16 or the handle of circuit breaker 22 when second actuator 50 moves to position itself over second row 24 of circuit breakers 22.

The remote operated device 30 can be installed on any typical electrical enclosure that has circuit breakers. The actuation means provided by remote operated device 30 is external to the circuit breakers, allowing standard circuit breakers to be utilized. Remote operated device 30 provides a number of advantages. First, remote operated device 30 is inexpensive to implement because a number of circuit breakers can be operated with one remote operated device; thus, each circuit breaker does not have to include actuation means. Another advantage is that the circuit beakers used with remote operated device 30 can be smaller than a circuit breaker with actuation means located within the circuit breaker. Finally, remote operated device 30 operates the circuit breakers in a sequential method. The sequential operation of the circuit breakers is preferred because the simultaneous switching of large loads can cause greater voltage fluctuations.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method of operating a plurality of circuit breakers, said method comprising:

receiving a first signal from a computer;

operating a first actuator to position a second actuator over a circuit breaker of a plurality of circuit breakers; and operating the second actuator to operate the circuit breaker.

2. The method of claim 1, further comprising receiving a second signal indicating a location of the circuit breaker.

3. The method of claim 2, wherein:

said receiving a first signal further comprises receiving a first signal at a controller; and said receiving a second signal further comprises receiving a second signal at a controller.

4. The method of claim 3, further comprising determining the handle position of the circuit breaker to be controlled.

5. The method of claim 1, further comprising operating a third actuator to move the second actuator to a second circuit breaker.

6. The method of claim 1, wherein said operating a first actuator further comprises:

operating a first actuator in response to the received first signal.

* * * * *